US011814801B2

(12) United States Patent
Chapman

(10) Patent No.: US 11,814,801 B2
(45) Date of Patent: Nov. 14, 2023

(54) FECAL MATTER RETRIEVAL AND DISPOSAL DEVICE AND METHOD OF USE

(71) Applicant: Brian Chapman, Bradenton, FL (US)

(72) Inventor: Brian Chapman, Bradenton, FL (US)

( * ) Notice: Subject to any disclaimer, the term of this patent is extended or adjusted under 35 U.S.C. 154(b) by 311 days.

(21) Appl. No.: 17/329,925

(22) Filed: May 25, 2021

(65) Prior Publication Data

US 2022/0380992 A1 Dec. 1, 2022

(51) Int. Cl.
*E01H 1/12* (2006.01)

(52) U.S. Cl.
CPC ..... *E01H 1/1206* (2013.01); *E01H 2001/128* (2013.01); *E01H 2001/1293* (2013.01)

(58) Field of Classification Search
CPC ..... E01H 1/1206; E01H 2001/128; E01H 2001/1293
See application file for complete search history.

(56) References Cited

U.S. PATENT DOCUMENTS

D253,913 S 1/1980 Hennessy
4,995,661 A 2/1991 Aurness
5,503,442 A 4/1996 Lee
5,601,321 A 2/1997 Simon
6,196,601 B1 3/2001 Juntunen, Jr.
7,448,659 B1 * 11/2008 Auseklis ..... E01H 1/1206 294/1.4
7,625,025 B1 * 12/2009 Zahedi ..... E01H 1/1206 294/1.3
7,992,907 B1 * 8/2011 DeJesus ..... E01H 1/1206 294/1.4
8,291,339 B2 10/2012 Auseklis
8,714,604 B1 * 5/2014 Mihalic ..... E01H 1/1206 294/1.4
11,248,739 B1 * 2/2022 Jordan ..... F16M 11/28
2004/0040588 A1 * 3/2004 Parigian ..... A45B 3/00 135/66
2004/0145196 A1 7/2004 Katz
2008/0303295 A1 * 12/2008 Moreno Fernandez De Betono ..... E01H 1/1206 294/1.3
2012/0256430 A1 * 10/2012 Merino-Garcia ..... E01H 1/1206 294/1.3
2014/0152031 A1 * 6/2014 Ballacchino ..... E01H 1/1206 294/1.3

* cited by examiner

*Primary Examiner* — Stephen A Vu

(57) ABSTRACT

A fecal matter retrieval and disposal device for sanitary collection and disposal of fecal matter includes a pole and a plurality of bags. A plurality of jaws and a handle are hingedly engaged to a bottom and a top of the pole, respectively. An actuator engaged to the handle selectively motivates the jaws between open and closed configurations, with the jaws being biased to the latter. The bags are nested and can engage and encase the jaws. A first actuation of the actuator allows positioning of the plurality of bags over a fecal matter deposit. A second actuation motivates the jaws to the closed configuration to wrap the plurality of bags around the fecal matter deposit, allowing an outermost bag to be tied off. A third actuation motivates the jaws to the open configuration, whereupon the outermost bag containing the fecal matter deposit drops from the jaws.

11 Claims, 10 Drawing Sheets

FECAL MATTER RETRIEVAL AND DISPOSAL DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to disposal devices and more particularly pertains to a new disposal device for sanitary collection and disposal of fecal matter. The present invention discloses a pole having a plurality of jaws and an actuator engaged at its ends. The jaws are configured to engage a plurality of bags. The actuator motivates the jaws first to open and then to close the bags sequentially around fecal matter, such that a fresh bag is used each time a collection of fecal matter is required.

(2) Description of Related Art Including Information Disclosed Under 37 CFR 1.97 and 1.98

The prior art relates to disposal devices for fecal matter, and in particular devices for collecting and disposal of pet waste. Prior art disposal devices for fecal matter generally comprise selectively closable jaws or scoops, which may be fitted with a bag. What is lacking in the prior art is a disposal device for fecal matter having a plurality of bags engaged to closable jaws, such that a fresh bag is available each time a collection of fecal matter is required.

BRIEF SUMMARY OF THE INVENTION

An embodiment of the disclosure meets the needs presented above by generally comprising a pole and a plurality of bags. A plurality of jaws is hingedly engaged to a bottom of the pole. A handle is engaged to a top of the pole and is configured to be grasped in a hand of a user. An actuator is engaged to the handle and is operationally engaged to the plurality of jaws. The actuator is positioned to selectively motivate the jaws between an open configuration and a closed configuration. The jaws are biased to the closed configuration. The bags are nested and are configured to engage the plurality of jaws so that the plurality of bags is engaged to and substantially encases the plurality of jaws. The actuator is configured to be actuated a first time to motivate the jaws from the closed configuration to the open configuration, positioning the user to position the plurality of bags over a fecal matter deposit. The actuator is configured to be actuated a second time to motivate the jaws to the closed configuration to wrap the plurality of bags around the fecal matter deposit, positioning the user to tie off an outermost one of the plurality of bags. The actuator is configured to be actuated a third time to motivate the jaws to the open configuration so that the outermost one of the plurality of bags containing the fecal matter deposit drops from the jaws.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
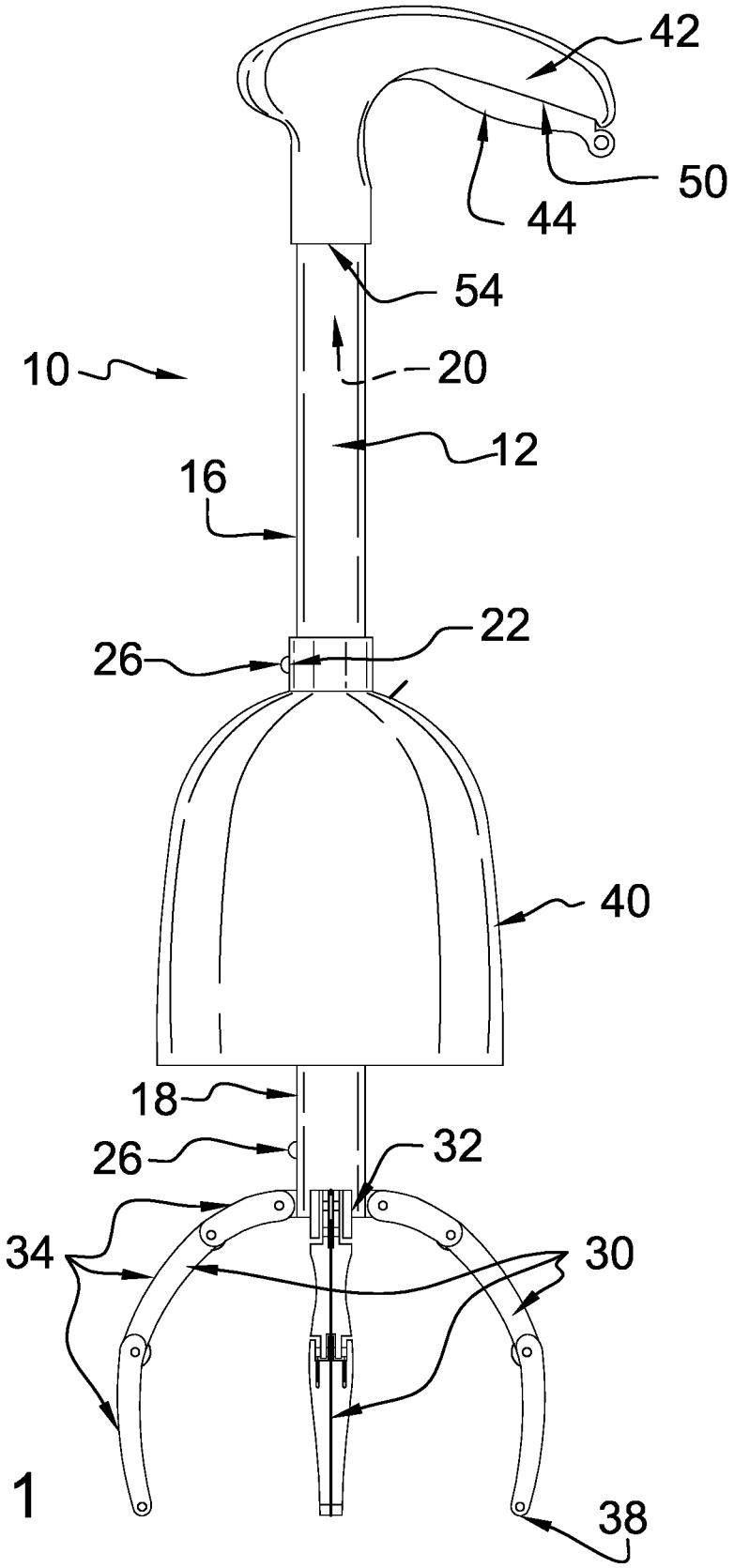
FIG. 1 is a side view of a fecal matter retrieval and disposal device according to an embodiment of the disclosure.

With reference now to the drawings, and in particular to FIGS. 1 through 10 thereof, a new disposal device embodying the principles and concepts of an embodiment of the disclosure and generally designated by the reference numeral 10 will be described.

As best illustrated in FIGS. 1 through 10, the fecal matter retrieval and disposal device 10 generally comprises a pole 12, which is tubular. The pole 12 comprises a plurality of nested sections 14 so that the pole 12 is selectively extensible. The plurality of nested sections 14 comprises an upper section 16 and a lower section 18. The lower section 18 is selectively extensible from the upper section 16.

A spring 20 is engaged to and positioned in the upper section 16. The spring 20 is engaged to the lower section 18 and is compressed when the lower section 18 is positioned within the upper section 16. A hole 22 is positioned in the upper section 16 proximate to a lower end 24 of the upper section 16. A pin 26, which is spring loaded, is engaged to and extends from the lower section 18 proximate to a lower limit 28 of the lower section 18. The pin 26 extends through the hole 22 to fixedly position the lower section 18 within the upper section 16. The pin 26 is configured to be depressed, such that the lower section 18 extends from the upper section 16. The present invention anticipates other engagement means for securing the lower section 18 to the upper section 16 to prevent retraction, such as, but not limited to, threads, clips, and the like.

Figure 2:
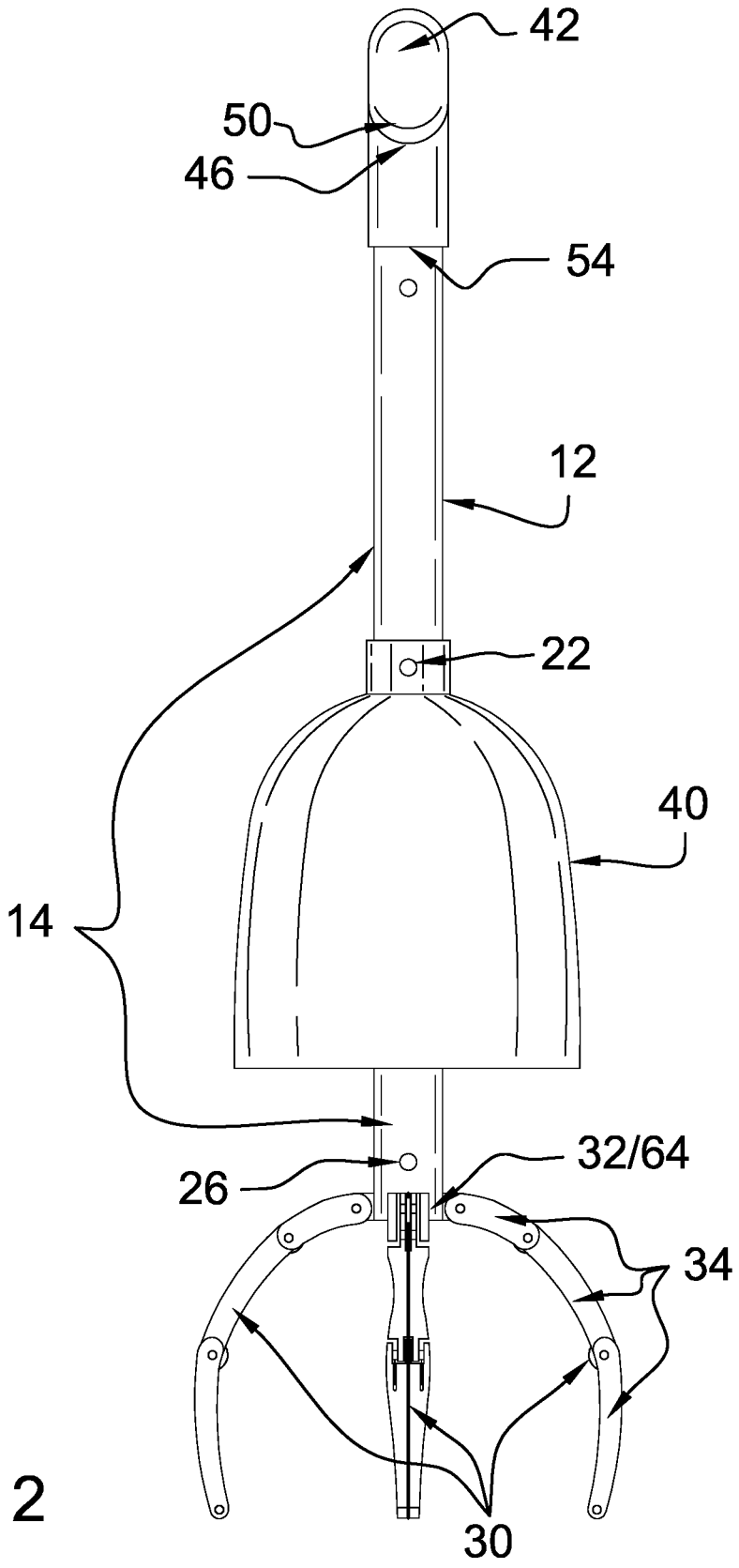
FIG. 2 is a rear view of an embodiment of the disclosure.
Figure 3:
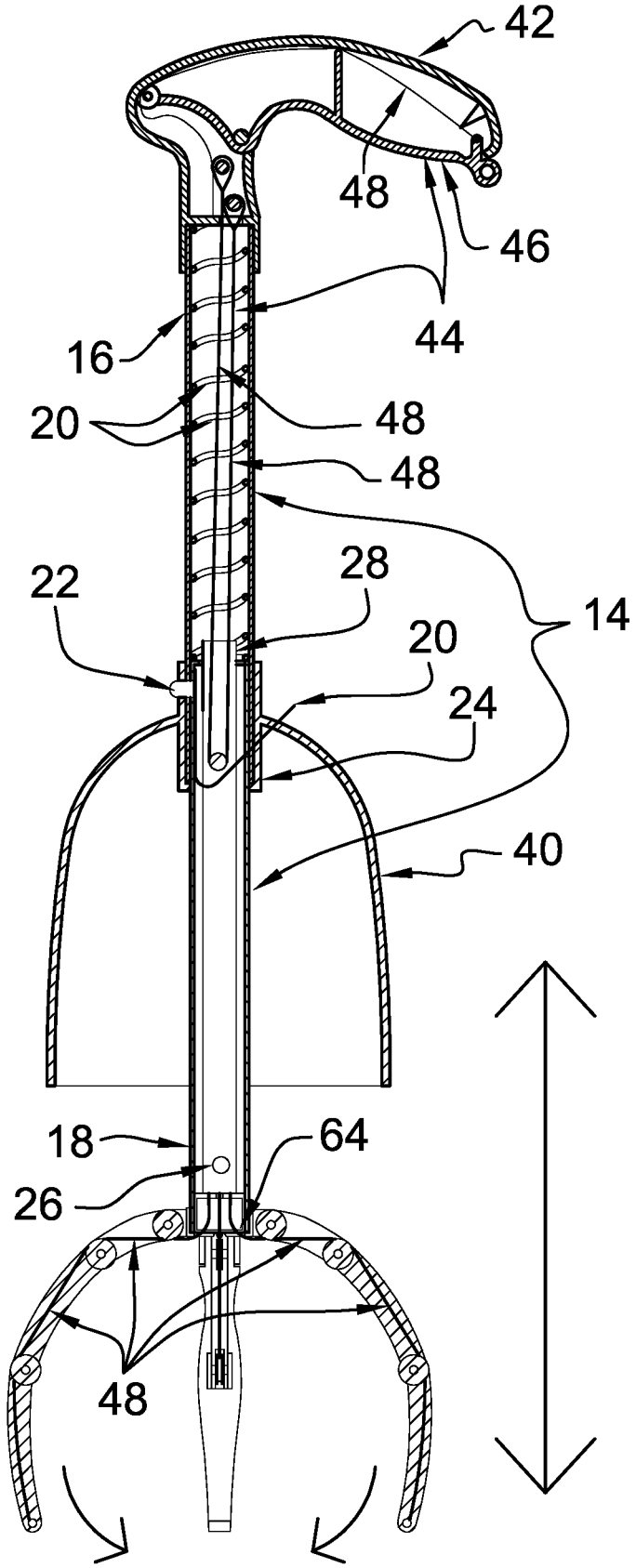
FIG. 3 is a cross-sectional view of an embodiment of the disclosure.

A plurality of jaws 30 is hingedly engaged to a bottom 32 of the pole 12. Each jaw 30 comprises a plurality of segments 34. The segments 34 are mutually hingedly engaged so that the jaws 30 are articulating. Each segment 34 is arcuate. As will become apparent, the segments 34 being arcuate enhances efficiency of the fecal matter retrieval and disposal device 10 in collecting fecal matter deposits. The plurality of jaws 30 may comprise four jaws 30, as shown in FIGS. 1-3, or other number of jaws 30, such as, but not limited to, three or five jaws 30.

Each of a plurality of sleeves 36 is positioned over and is engaged to a tip 38 of a respective jaw 30 distal from the bottom 32 of the pole 12. The sleeves 36 comprise one or more of rubber, silicone, and elastomer so that the sleeves 36 are resiliently compressible.

A housing 40 is engaged to and extends from the upper section 16 proximate to the lower end 24 of the upper section 16. The housing 40 is bell shaped and thus is positioned for insertion of the plurality of jaws 30 as the lower section 18 is retracted into the upper section 16.

Figure 7:
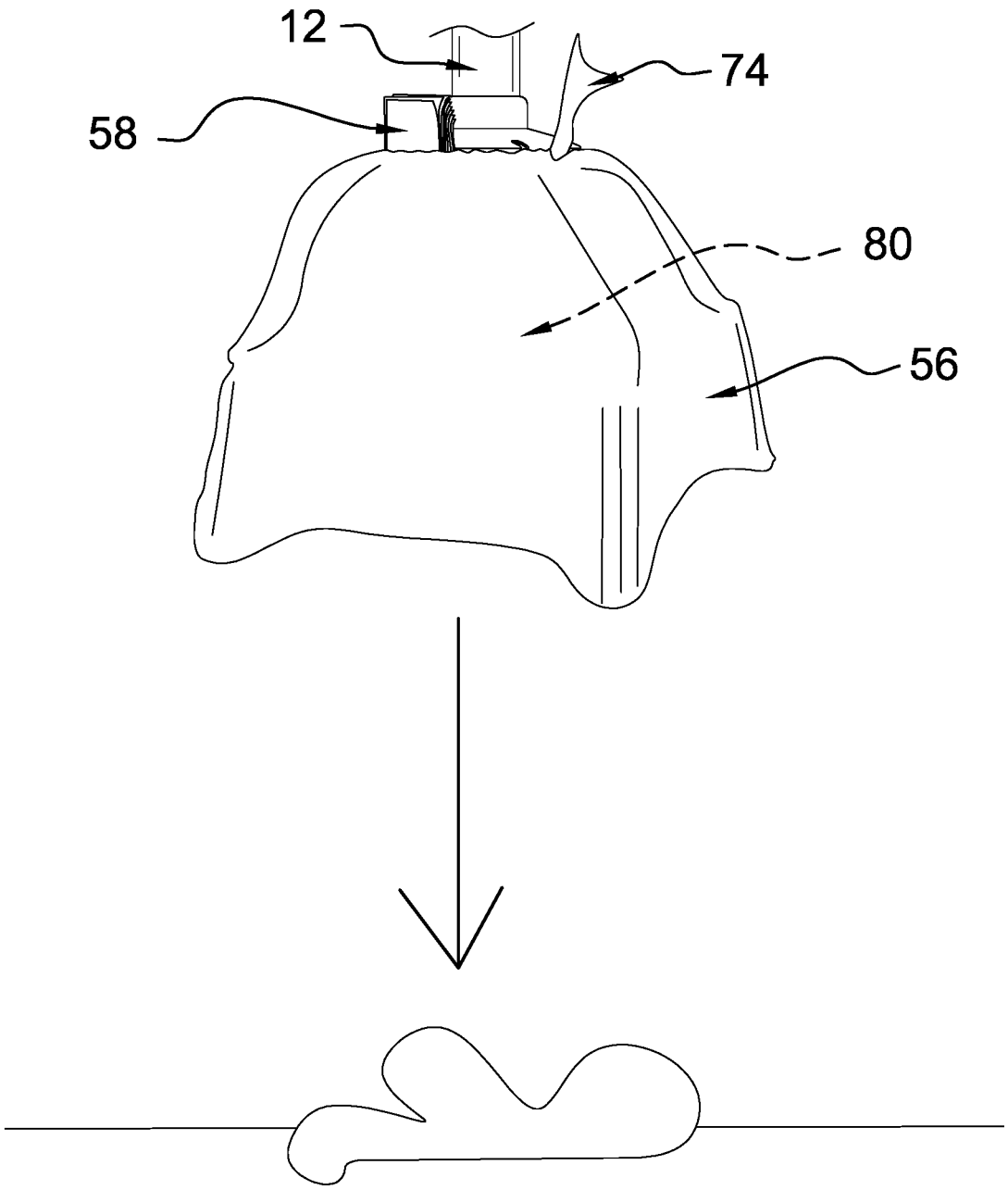
FIG. 7 is an in-use view of an embodiment of the disclosure.
Figure 8:
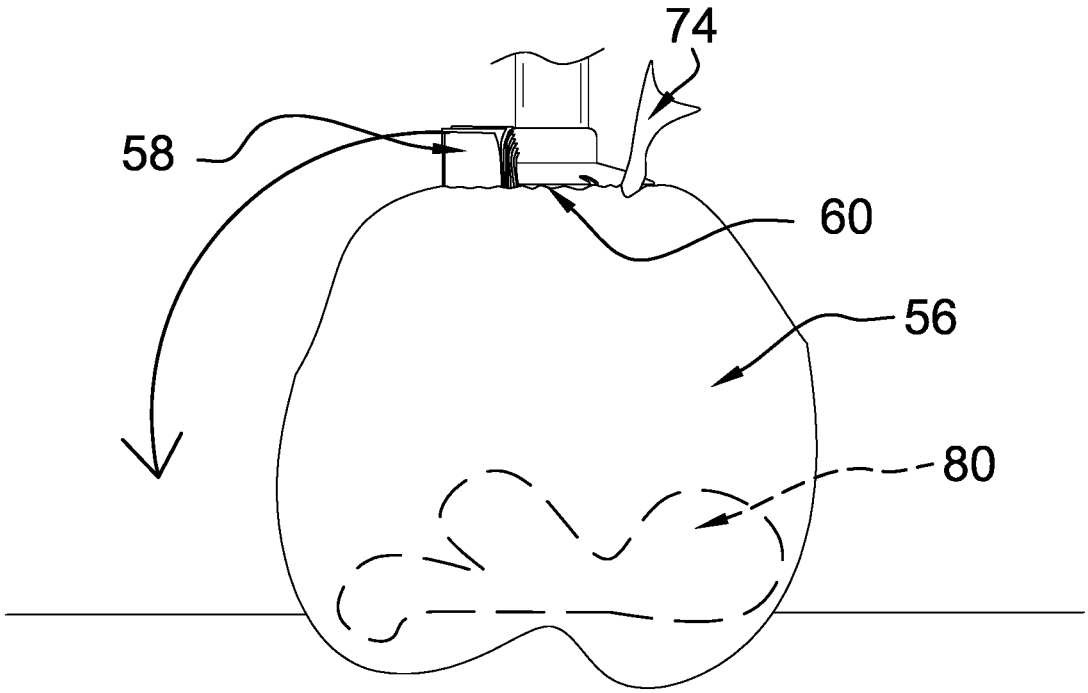
FIG. 8 is an in-use view of an embodiment of the disclosure.
Figure 9:
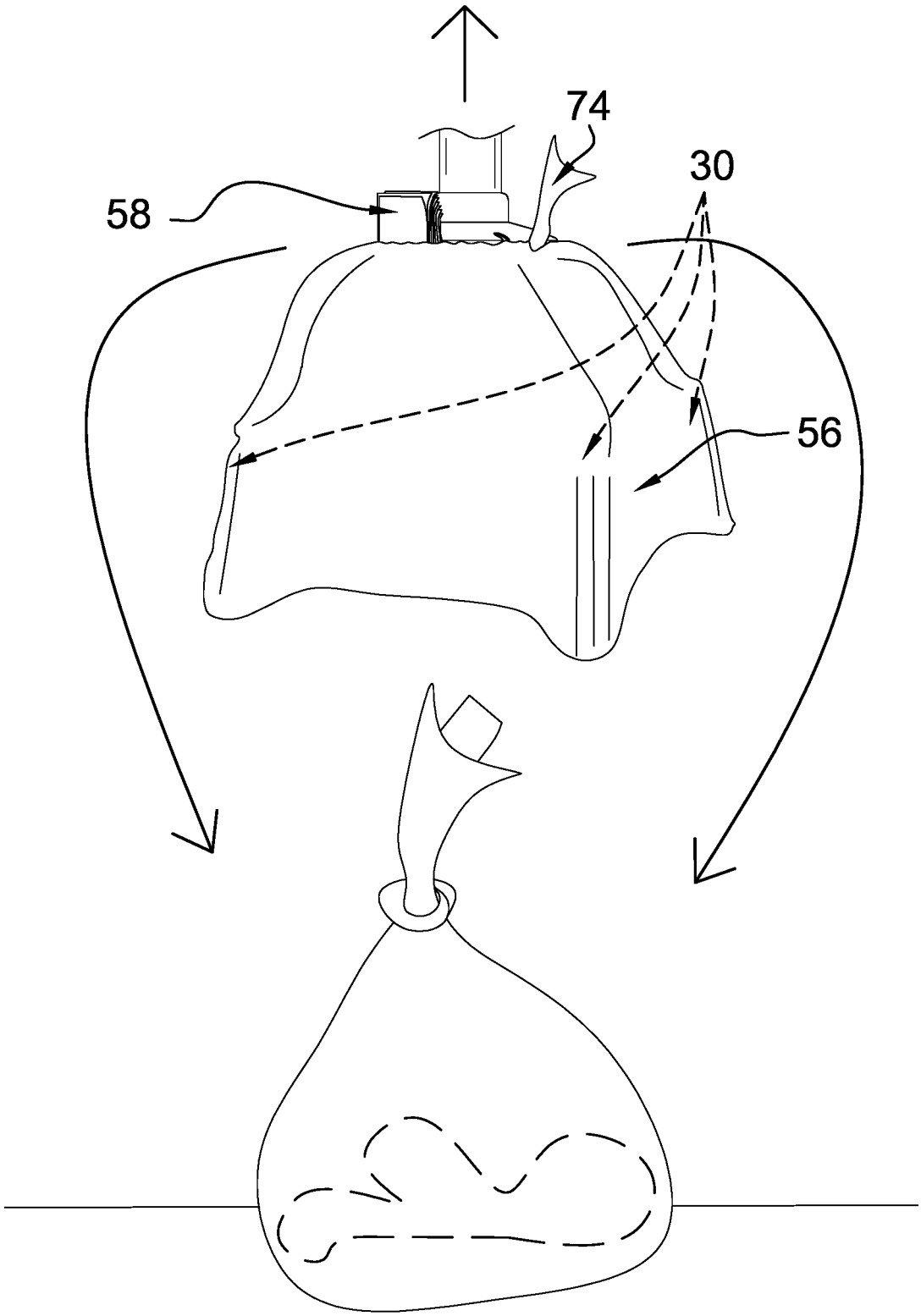
FIG. 9 is an in-use view of an embodiment of the disclosure.
Figure 10:
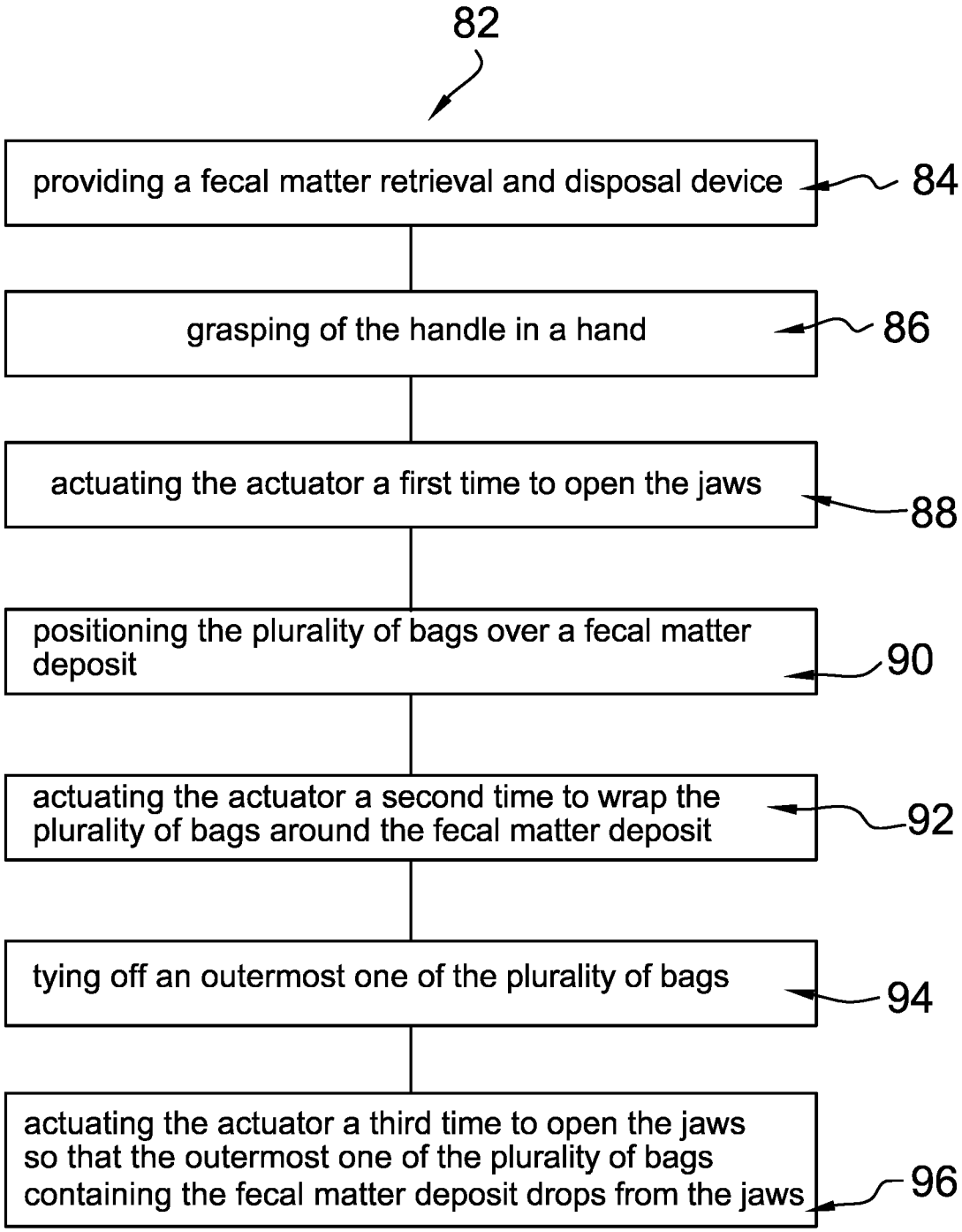
FIG. 10 is a flow diagram for a method utilizing an embodiment of the disclosure.

A handle 42 is engaged to a top 54 of the pole 12. An actuator 44 is engaged to the handle 42 and is operationally engaged to the plurality of jaws 30. The actuator 44 is positioned to selectively motivate the jaws 30 between an open configuration, as shown in FIGS. 7 and 9, and a closed configuration, as shown in FIG. 8. The jaws 30 are biased to the closed configuration.

The actuator 44 may comprise a lever 46 and a cable 48, or other actuating means, such as, but not limited to, linear actuators, motors, and the like. The lever 46 is engaged to an underside 50 of the handle 42 and is spring loaded so that the lever 46 is biased to a non-levered configuration. The cable 48 is operationally engaged to and extends between the lever 46 and the plurality of jaws 30. The lever 46 is configured to be levered upon tightening of a grasp of a hand of a user upon the handle 42 so that the jaws 30 are motivated from the closed configuration to the open configuration. The lever 46 returns to the non-levered configuration upon loosening of the grasp of the user upon the handle 42, concurrently with the jaws 30 being motivated to the closed configuration.

Figure 4:
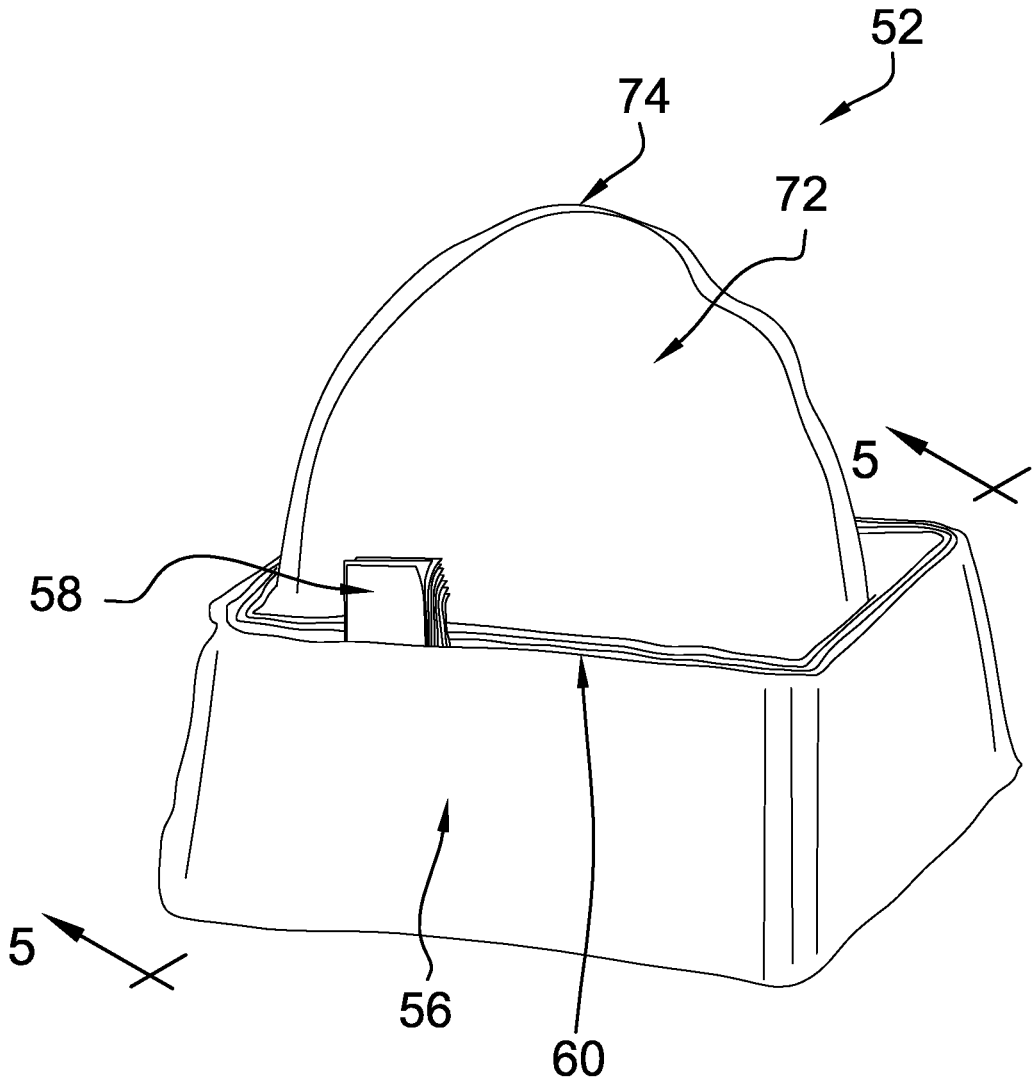
FIG. 4 is an isometric perspective view of an embodiment of the disclosure.
Figure 5:
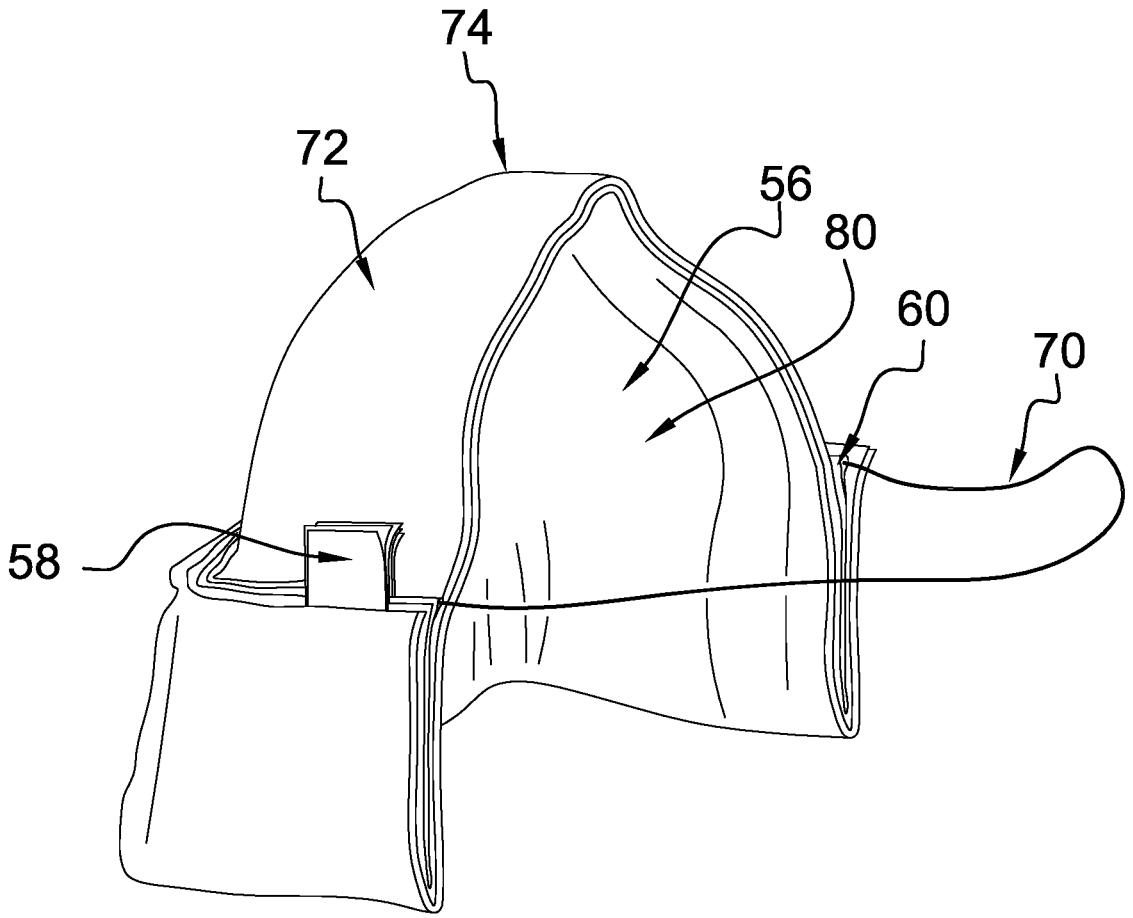
FIG. 5 is a cross-sectional view of an embodiment of the disclosure.
Figure 6:
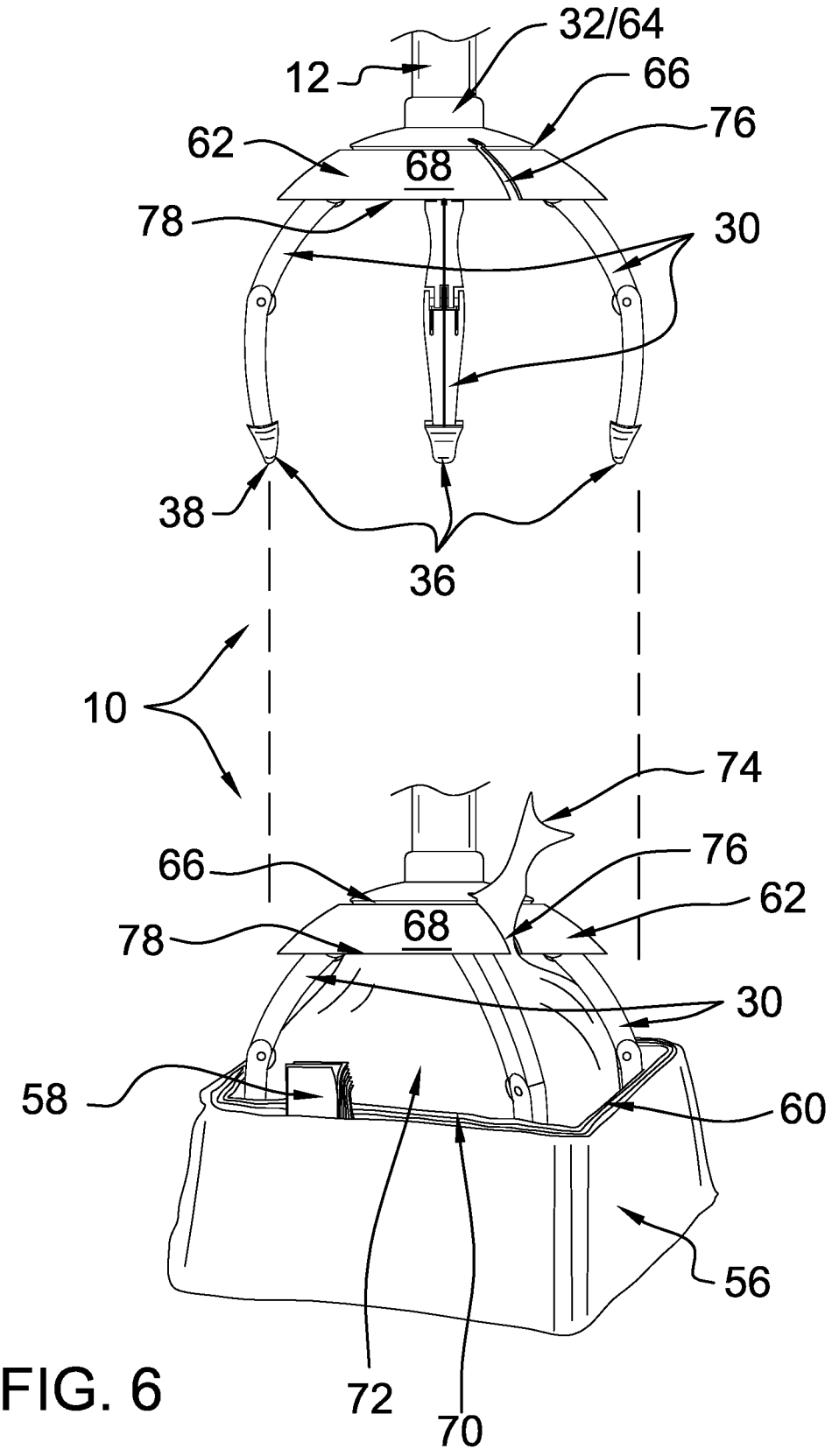
FIG. 6 is an in-use view of an embodiment of the disclosure.

The fecal matter retrieval and disposal device 10 also comprises a plurality of bags 52, as shown in FIG. 4. The bags 52 are nested and are configured to engage the plurality of jaws 30 so that the plurality of bags 52 is engaged to and substantially encases the plurality of jaws 30, as shown in FIG. 7.

The handle 42 is configured to be grasped in the hand of the user to position the plurality of bags 52 over a fecal matter deposit. The actuator 44 is configured to be actuated a first time to motivate the jaws 30 from the closed configuration to the open configuration, positioning the user to position the plurality of bags 52 over a fecal matter deposit. The actuator 44 is configured to be actuated a second time to motivate the jaws 30 to the closed configuration to wrap the plurality of bags 52 around the fecal matter deposit, positioning the user to tie off an outermost one 56 of the plurality of bags 52. The actuator 44 is configured to be actuated a third time to motivate the jaws 30 to the open configuration so that the outermost one 56 of the plurality of bags 52 containing the fecal matter deposit drops from the jaws 30.

Each of a plurality of tabs 58 is engaged to and extends from a respective bag 52 proximate to an open end 60 of the respective bag 52. The tab 58 that is engaged to the outermost one 56 of the bags 52 is configured to be grasped in digits of the hand of the user so that the user is positioned to separate the outermost one 56 of the bags 52 from the plurality of bags 52. The outermost one 56 of the bags 52 thus is configured to be tied off.

A disc 62 is engaged to and extends arcuately from a lower limit 64 of the lower section 18 so that the disc 62 extends partially over the plurality of jaws 30. A recess 66 extends into an outer surface 68 of the disc 62 and extends annularly around the disc 62. A band 70 is engaged to an innermost one 72 of the plurality of bags 52 and extends circumferentially around the innermost one 72 of the bags 52 proximate to the open end 60. The band 70 comprises elastic so that the band 70 is stretchable around the disc 62. The band 70 engages the disc 62 upon rebounding and insertion into the recess 66 so that the plurality of bags 52 is engaged to the disc 62.

The plurality of bags 52 may be sized so that a closed ends 74 of the bags 52 are positionable within the plurality of jaws 30 and extend to proximate to the bottom 32 of the pole 12. A slot 76 extends radially into the disc 62 from a perimeter 78 of the disc 62. The slot 76 is positioned for insertion of the closed ends 74 of the bags 52 so that the plurality of bags 52 is engaged to the disc 62. Thus positioned, the plurality of bags 52 defines a cavity 80 within the plurality of jaws 30. The cavity 80 is configured for insertion of the fecal matter deposit as the plurality of bags 52 is positioned over the fecal matter deposit.

The present invention also anticipates a coupler (not shown), which is engaged to the housing 40 or to the pole 12 and which is configured to engage a leash so that the fecal matter retrieval and disposal device 10 is engaged to the leash. With the leash being engaged to the fecal matter retrieval and disposal device 10, the user would have both hands free to operate the fecal matter retrieval and disposal device 10.

In use, the fecal matter retrieval and disposal device 10 enables a method 82 of retrieving and disposing of fecal matter. The method 82 comprises a first step 84 of providing a fecal matter retrieval and disposal device 10 according to the specification above. A second step 86 of the method 82 is grasping of the handle 42 in a hand of a user. A third step 88 of the method 82 is actuating the actuator 44 a first time to motivate the jaws 30 from the closed configuration to the open configuration. A fourth step 90 of the method 82 entails positioning the plurality of bags 52 over a fecal matter deposit. A fifth step 90 of the method 82 is actuating the actuator 44 a second time to motivate the jaws 30 to the closed configuration to wrap the plurality of bags 52 around the fecal matter deposit. A sixth step 92 of the method 82 is tying off an outermost one 56 of the plurality of bags 52. A seventh step 94 of the method 82 is actuating the actuator 44 a third time to motivate the jaws 30 to the open configuration so that the outermost one 56 of the plurality of bags 52 containing the fecal matter deposit drops from the jaws 30. A fresh outermost one 56 of the plurality of bags 52 then is available for collecting the next fecal matter deposit.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fecal matter retrieval and disposal device comprising:

a pole;

a plurality of jaws hingedly engaged to a bottom of the pole;

a handle engaged to a top of the pole;

an actuator engaged to the handle and being operationally engaged to the plurality of jaws, such that the actuator is positioned for selectively motivating the jaws between an open configuration and a closed configuration, the jaws being biased to the closed configuration;

a plurality of bags, the bags being nested and configured for engaging the plurality of jaws, such that the plurality of bags is engaged to and substantially encases the plurality of jaws, wherein the handle is configured for grasping in a hand of a user, wherein the actuator is configured for being actuated a first time for motivating the jaws from the open configuration to the open configuration, positioning the user for positioning the plurality of bags over a fecal matter deposit, wherein the actuator is configured for being actuated a second time for motivating the jaws to the closed configuration for wrapping the plurality of bags around the fecal matter deposit, positioning the user for tying off an outermost one of the plurality of bags, wherein the actuator is configured for being actuated a third time for motivating the jaws to the open configuration, such that the outermost one of the plurality of bags containing the fecal matter deposit drops from the jaws; and a plurality of tabs, each tab being engaged to and extending from a respective bag proximate to an open end of the respective bag, wherein the tab engaged to the outermost one of the bags is configured for grasping in digits of the hand of the user, positioning the user for separating the outermost one of the bags from the plurality of bags, wherein the outermost one of the bags is configured for tying off.

2. The fecal matter retrieval and disposal device of claim 1, wherein:

the pole is tubular; and the pole comprises a plurality of nested sections, such that the pole is selectively extensible.

3. The fecal matter retrieval and disposal device of claim 2, wherein the plurality of nested sections comprises an upper section and a lower section, the lower section being selectively extensible from the upper section.

4. The fecal matter retrieval and disposal device of claim 3, further including:

a spring engaged to and positioned in the upper section, the spring being engaged to the lower section, such that the spring is compressed when the lower section is positioned in the upper section;

a hole positioned in the upper section proximate to a lower end of the upper section; and a pin engaged to and extending from the lower section proximate to a lower limit of the lower section, the pin being spring loaded, such that the pin extends through the hole for fixedly positioning the lower section within the upper section, wherein the pin is configured for depressing, such that the lower section extends from the upper section.

5. The fecal matter retrieval and disposal device of claim 1, further including a plurality of sleeves, each sleeve being positioned over and engaged to a tip of a respective jaw distal from the bottom of the pole, the sleeve comprising a material chosen from a group of materials consisting of rubber, silicone, and elastomer, such that the sleeve is resiliently compressible.

6. A fecal matter retrieval and disposal device comprising:

a pole;

a plurality of jaws hingedly engaged to a bottom of the pole;

a handle engaged to a top of the pole;

an actuator engaged to the handle and being operationally engaged to the plurality of jaws, such that the actuator is positioned for selectively motivating the jaws between an open configuration and a closed configuration, the jaws being biased to the closed configuration;

a plurality of bags, the bags being nested and configured for engaging the plurality of jaws, such that the plurality of bags is engaged to and substantially encases the plurality of jaws, wherein the handle is configured for grasping in a hand of a user, wherein the actuator is configured for being actuated a first time for motivating the jaws from the open configuration to the open configuration, positioning the user for positioning the plurality of bags over a fecal matter deposit, wherein the actuator is configured for being actuated a second time for motivating the jaws to the closed configuration for wrapping the plurality of bags around the fecal matter deposit, positioning the user for tying off an outermost one of the plurality of bags, wherein the actuator is configured for being actuated a third time for motivating the jaws to the open configuration, such that the outermost one of the plurality of bags containing the fecal matter deposit drops from the jaws;

wherein each jaw comprises a plurality of segments, the segments being mutually hingedly engaged, such that the jaws are articulating; and wherein the actuator comprises:

a lever engaged to an underside of the handle, the lever being spring loaded, such that the lever is biased to a non-levered configuration, and a cable operationally engaged to and extending between the lever and the plurality of jaws, wherein the lever is configured for being levered upon tightening of a grasp of the hand of the user upon the handle, such that the jaws are motivated from the closed configuration to the open configuration, such that the lever returns to the non-levered configuration upon loosening of the grasp of the user upon the handle, concurrently with the jaws being motivated to the closed configuration.

7. The fecal matter retrieval and disposal device of claim 6, wherein each segment is arcuate.

8. A fecal matter retrieval and disposal device comprising:

a pole;

a plurality of jaws hingedly engaged to a bottom of the pole;

a handle engaged to a top of the pole;

an actuator engaged to the handle and being operationally engaged to the plurality of jaws, such that the actuator is positioned for selectively motivating the jaws between an open configuration and a closed configuration, the jaws being biased to the closed configuration;

a plurality of bags, the bags being nested and configured for engaging the plurality of jaws, such that the plurality of bags is engaged to and substantially encases the plurality of jaws, wherein the handle is configured for grasping in a hand of a user, wherein the actuator is configured for being actuated a first time for motivating the jaws from the open configuration to the open configuration, positioning the user for positioning the plurality of bags over a fecal matter deposit, wherein the actuator is configured for being actuated a second time for motivating the jaws to the closed configuration for wrapping the plurality of bags around the fecal matter deposit, positioning the user for tying off an outermost one of the plurality of bags, wherein the actuator is configured for being actuated a third time for motivating the jaws to the open configuration, such that the outermost one of the plurality of bags containing the fecal matter deposit drops from the jaws;

wherein the pole is tubular;

wherein the pole comprises a plurality of nested sections, such that the pole is selectively extensible;

wherein the plurality of nested sections comprises an upper section and a lower section, the lower section being selectively extensible from the upper section; and a housing engaged to and extending from the upper section proximate to a lower end of the upper section, the housing being bell shaped, such that the housing is positioned for insertion of the plurality of jaws as the lower section is retracted into the upper section.

9. A fecal matter retrieval and disposal device comprising:

a pole;

a plurality of jaws hingedly engaged to a bottom of the pole;

a handle engaged to a top of the pole;

an actuator engaged to the handle and being operationally engaged to the plurality of jaws, such that the actuator is positioned for selectively motivating the jaws between an open configuration and a closed configuration, the jaws being biased to the closed configuration;

a plurality of bags, the bags being nested and configured for engaging the plurality of jaws, such that the plurality of bags is engaged to and substantially encases the plurality of jaws, wherein the handle is configured for grasping in a hand of a user, wherein the actuator is configured for being actuated a first time for motivating the jaws from the open configuration to the open configuration, positioning the user for positioning the plurality of bags over a fecal matter deposit, wherein the actuator is configured for being actuated a second time for motivating the jaws to the closed configuration for wrapping the plurality of bags around the fecal matter deposit, positioning the user for tying off an outermost one of the plurality of bags, wherein the actuator is configured for being actuated a third time for motivating the jaws to the open configuration, such that the outermost one of the plurality of bags containing the fecal matter deposit drops from the jaws;

wherein the pole is tubular;

wherein the pole comprises a plurality of nested sections, such that the pole is selectively extensible;

wherein the plurality of nested sections comprises an upper section and a lower section, the lower section being selectively extensible from the upper section;

a disc engaged to and extending arcuately from a lower limit of the lower section, such that the disc extends partially over the plurality of jaws;

a recess extending into an outer surface of the disc and extending annularly around the disc; and a band engaged to an innermost one of the plurality of bags and extending circumferentially around the innermost one of the bags proximate to the open end, the band comprising elastic such that the band is stretchable around the disc, such that the band engages the disc upon rebounding and inserting into the recess, such that the plurality of bags is engaged to the disc.

10. The fecal matter retrieval and disposal device of claim 9, further including:

the plurality of bags being sized such that closed ends of the bags are positionable within the plurality of jaws and extend to proximate to the bottom of the pole; and a slot extending radially into the disc from a perimeter of the disc, such that the slot is positioned for insertion of the closed ends of the bags, such that the plurality of bags is engaged to the disc and defines a cavity within the plurality of jaws, wherein the cavity is configured for insertion of the fecal matter deposit.

11. A fecal matter retrieval and disposal device comprising:

a pole, the pole being tubular, the pole comprising a plurality of nested sections, such that the pole is selectively extensible, the plurality of nested sections comprising an upper section and a lower section, the lower section being selectively extensible from the upper section;

a spring engaged to and positioned in the upper section, the spring being engaged to the lower section, such that the spring is compressed when the lower section is positioned in the upper section;

a hole positioned in the upper section proximate to a lower end of the upper section;

a pin engaged to and extending from the lower section proximate to a lower limit of the lower section, the pin being spring loaded, such that the pin extends through the hole for fixedly positioning the lower section relative within the upper section, wherein the pin is configured for depressing, such that the lower section extends from the upper section;

a plurality of jaws hingedly engaged to a bottom of the pole, each jaw comprising a plurality of segments, the segments being mutually hingedly engaged, such that the jaws are articulating, each segment being arcuate;

a plurality of sleeves, each sleeve being positioned over and engaged to a tip of a respective jaw distal from the bottom of the pole, the sleeve comprising a material chosen from a group of materials consisting of rubber, silicone, and elastomer, such that the sleeve is resiliently compressible;

a handle engaged to a top of the pole;

an actuator engaged to the handle and being operationally engaged to the plurality of jaws, such that the actuator is positioned for selectively motivating the jaws between an open configuration and a closed configuration, the jaws being biased to the closed configuration, the actuator comprising:

a lever engaged to an underside of the handle, the lever being spring loaded, such that the lever is biased to a non-levered configuration, and a cable operationally engaged to and extending between the lever and the plurality of jaws, wherein the lever is configured for being levered upon tightening of a grasp of the hand of the user upon the handle, such that the jaws are motivated from the closed configuration to the open configuration, such that the lever returns to the non-levered configuration upon loosening of the grasp of the user upon the handle, concurrently with the jaws being motivated to the closed configuration;

a housing engaged to and extending from the upper section proximate to the lower end of the upper section, the housing being bell shaped, such that the housing is positioned for insertion of the plurality of jaws as the lower section is retracted into the upper section;

a plurality of bags, the bags being nested and configured for engaging the plurality of jaws, such that the plurality of bags is engaged to and substantially encases the plurality of jaws, wherein the handle is configured for grasping in the hand of the user, wherein the actuator is configured for being actuated a first time for motivating the jaws from the open configuration to the open configuration, positioning the user for positioning the plurality of bags over a fecal matter deposit, wherein the actuator is configured for being actuated a second time for motivating the jaws to the closed configuration for wrapping the plurality of bags around the fecal matter deposit, positioning the user for tying off an outermost one of the plurality of bags, wherein the actuator is configured for being actuated a third time for motivating the jaws to the open configuration, such that the outermost one of the plurality of bags containing the fecal matter deposit drops from the jaws, the plurality of bags being sized such that closed ends of the bags are positionable within the plurality of jaws and extend to proximate to the bottom of the pole;

a plurality of tabs, each tab being engaged to and extending from a respective bag proximate to an open end of the respective bag, wherein the tab engaged to the outermost one of the bags is configured for grasping in digits of the hand of the user, positioning the user for separating the outermost one of the bags from the plurality of bags, wherein the outermost one of the bags is configured for tying off;

a disc engaged to and extending arcuately from a lower limit of the lower section, such that the disc extends partially over the plurality of jaws;

a recess extending into an outer surface of the disc and extending annularly around the disc;

a band engaged to an innermost one of the plurality of bags and extending circumferentially around the innermost one of the bags proximate to the open end, the band comprising elastic such that the band is stretchable around the disc, such that the band engages the disc upon rebounding and inserting into the recess, such that the plurality of bags is engaged to the disc; and a slot extending radially into the disc from a perimeter of the disc, such that the slot is positioned for insertion of the closed ends of the bags, such that the plurality of bags is engaged to the disc and defines a cavity within the plurality of jaws, wherein the cavity is configured for insertion of the fecal matter deposit.

* * * * *